US012442581B2

(12) United States Patent
Huang et al.

(10) Patent No.: US 12,442,581 B2
(45) Date of Patent: Oct. 14, 2025

(54) MODULAR REFRIGERATION SYSTEM FOR STORING PRODUCTS

(71) Applicant: PepsiCo, Inc., Purchase, NY (US)

(72) Inventors: Minjun Huang, Garnerville, NY (US); Cheuk Chi Lau, White Plains, NY (US); Xuejun Li, Pleasantville, NY (US); Naga Srinivas Vankadari, White Plains, NY (US)

(73) Assignee: PepsiCo, Inc., Purchase, NY (US)

( * ) Notice: Subject to any disclaimer, the term of this patent is extended or adjusted under 35 U.S.C. 154(b) by 344 days.

(21) Appl. No.: 17/930,613

(22) Filed: Sep. 8, 2022

(65) Prior Publication Data

US 2024/0085087 A1 Mar. 14, 2024

(51) Int. Cl.
*F25D 17/06* (2006.01)

(52) U.S. Cl.
CPC ..... *F25D 17/062* (2013.01)

(58) Field of Classification Search
CPC ..... F25D 17/062; F25D 25/025; F25D 13/02; F25D 23/023
See application file for complete search history.

(56) References Cited

U.S. PATENT DOCUMENTS 8,496,308 B2 * 7/2013 Zabbatino ..... F25D 23/025 312/407
2004/0065579 A1 4/2004 Wood
2011/0277489 A1 11/2011 Schalla et al.
2016/0286998 A1 10/2016 Lindbo
2018/0114386 A1 * 4/2018 Steinmetz ..... G07C 9/00571
2019/0344930 A1 11/2019 Jessie
(Continued)

FOREIGN PATENT DOCUMENTS

CN 106415164 A * 2/2017 ..... A23B 4/06
KR 20130013536 A * 2/2013 ..... F25D 13/02
WO 2015178027 A1 11/2015

OTHER PUBLICATIONS

English language machine translation of CN106415164 to Imam et al. Translated Dec. 2024 (Year: 2017).*
(Continued)

*Primary Examiner* — Cassey D Bauer
(74) *Attorney, Agent, or Firm* — Sterne, Kessler, Goldstein &Fox P.L.L.C.

(57) ABSTRACT

Embodiments described herein can include one or more modular storage units for use with a refrigerator system. The modular storage units can include a door that is movable from a closed position to an open position; a back wall; side walls; and a base. The modular storage unit can have an air inlet disposed in the back wall for receiving chilled air from the refrigeration system. The modular storage unit can include a temperature sensor that detects the temperature within the interior volume and an insulating wall comprising a phase change material disposed within the insulating wall. The modular storage unit can include a locking system configured to lock the door. Multiple modular storage units can be used in one refrigerator system, and each can be removably coupled to an interior storage compartment of the refrigerator system. Embodiments described herein can be integrated into existing refrigeration systems.

19 Claims, 12 Drawing Sheets

(56) References Cited

U.S. PATENT DOCUMENTS

| | | | | |
|---|---|---|---|---|
| 2021/0095909 | A1 | 4/2021 | Ellis et al. | |
| 2024/0318890 | A1 * | 9/2024 | Frost | F25D 3/00 |

OTHER PUBLICATIONS

Machine English language translation of KR20130013536 to Woo. Translated Apr. 2025 (Year: 2013).*

International Search Report and Written Opinion in counterpart International Application No. PCT/US2023/073296, mailed Jan. 4, 2024 (9 pages).

* cited by examiner

MODULAR REFRIGERATION SYSTEM FOR STORING PRODUCTS

BACKGROUND

The present disclosure relates to systems and methods for controlling the temperature of products (e.g., beverages and snacks). Specifically, the present disclosure relates to refrigeration systems that includes modular units for localized control of temperatures within each modular unit.

BRIEF SUMMARY

Some embodiments are directed to a system for refrigerating a product that includes a storage compartment; a cooling system; and a modular unit removably coupled to the storage compartment. In some embodiments, the cooling system is configured to deliver chilled air to the storage compartment. In some embodiments, the modular unit includes an interior volume. In some embodiments, the system is configured to adjust a temperature within the interior volume independently of a temperature within the storage compartment.

In some embodiments, the system includes a damper configured to move between a first position and a second position to redirect chilled air the modular unit. In some embodiments, damper is configured to move between the first position and the second position in response to a change in temperature within the modular unit as detected by a temperature sensor.

In some embodiments, the system includes a fan that is configured to direct air from a first end of the modular unit to a second end of the modular unit.

In some embodiments, the system includes a wall extending between a top end of the storage compartment to a bottom end of the storage compartment. In some embodiments, the wall extends between a refrigeration unit and the modular unit. In some embodiments, the wall defines an air flow path from the refrigeration unit to the modular unit. In some embodiments, the wall includes a phase change material disposed within the wall.

In some embodiments, the system includes a locking system and a temperature sensor, wherein the locking system is configured to lock the modular unit when the temperature sensor detects that the temperature of the interior volume is greater than a predetermined temperature.

Some embodiments are directed to a modular storage unit for a refrigeration system. In some embodiments, the modular storage unit includes an interior volume defined by a door, a back wall, side walls, and a based. In some embodiments, the door is movable from a closed position to an open position. In some embodiments, the modular storage unit includes an air inlet for receiving chilled air from the refrigeration system; a temperature sensor configured to detect the temperature within the interior volume; an insulating wall comprising a phase change material disposed within the insulating wall. In some embodiments, the insulating wall is oriented in a first direction that is substantially perpendicular to the back wall. In some embodiments, the modular storage unit includes a locking system configured to lock the door. In some embodiments, the modular storage unit is removably coupled to an interior storage compartment of the refrigeration system.

In some embodiments, the modular storage unit comprising a second insulating wall oriented in the first direction. In some embodiments, the insulating wall and the second insulating wall are each movable in a second direction that is perpendicular to the first direction.

In some embodiments, the modular storage unit includes a U-shaped insulating tray, wherein the U-shaped insulating tray comprises the insulating wall and the second insulating wall.

In some embodiments, the locking system is configured to lock the door in response to the temperature sensor detecting that the temperature within the interior volume exceeds a predetermined temperature. In some embodiments, the locking system is configured to unlock the door in response to the temperature sensor detecting that the temperature within the interior volume is less than the predetermined temperature.

In some embodiments, the locking system includes an electromagnetic lock. In some embodiments, the electromagnetic lock is a fail secure lock.

In some embodiments, the modular storage unit includes an indicator disposed on the door, wherein the indicator provides an indication that the locking system is locked.

Some embodiments are directed to a modular unit for a refrigeration system that includes an interior volume defined by a door having an inner surface facing the interior volume and an outer surface, the door movable from a closed position to an open position; a back wall, the back wall comprising a phase change material disposed within the back wall; side walls; a base; and a top wall; and an air duct extending from the back wall to a front end of the modular storage unit, wherein the air duct is configured to deliver chilled air from the refrigeration system to the an area proximate to the outer surface of the door.

In some embodiments, the door is recessed from a front end of the sides walls such that the chilled air delivered through the air duct forms an air curtain.

In some embodiments, the modular unit includes a fan configured to move the chilled air from the refrigeration system through the air duct.

DETAILED DESCRIPTION

Figure 1:
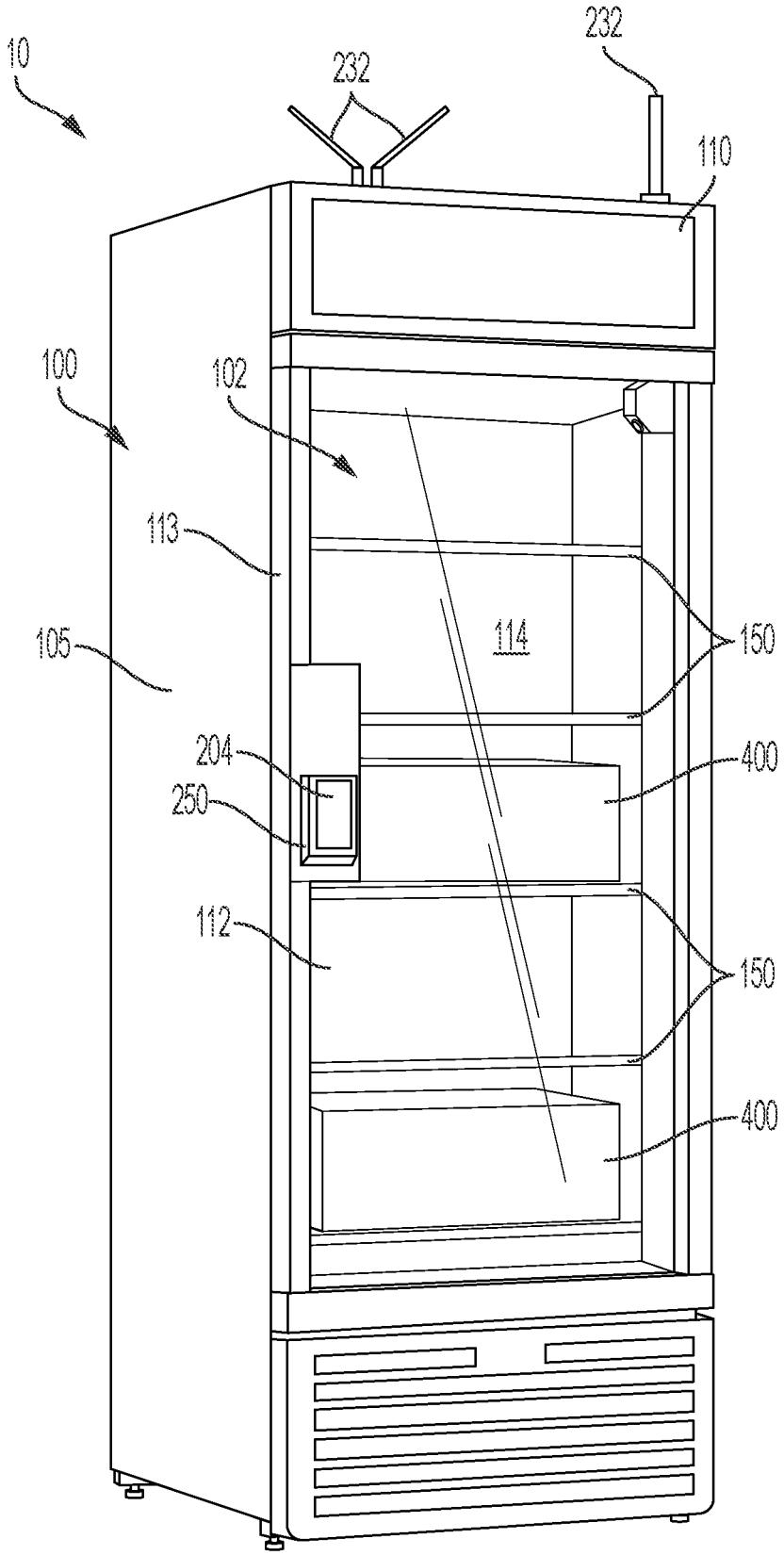
FIG. 1 shows a refrigeration system including modular units according to some embodiments.

Refrigerated systems (e.g., refrigerators and coolers) are commonly used to store products (e.g., beverages and snacks) in a temperature controlled environment. These refrigerated systems can be used at various locations, such as grocery stores, convenience stores, shopping malls, sporting or concert venues, gas stations, offices, and movie theaters, among others. These refrigerated systems often have doors that allow easy access to the produces stored within the system. Although these systems offer convenience, they can be challenging to maintain at chilled temperatures because of frequent opening of the doors, and they include several other drawbacks.

Refrigerated systems typically have a single compartment that is maintained at or near a target temperature. generally maintain a single temperature throughout the entire system, despite the fact that various products may have different temperature requirements. Typically this means the temperature for the entire system must be maintained at or below a temperature suitable for the product with the lowest temperature requirement. Existing systems typically do not allow a single system to maintain different temperatures for different zones of the system.

Some refrigerated systems have a lock-out function that will prevent access to the system if, for example, the refrigeration unit malfunctions or the temperature exceeds a maximum temperature for a product stored within the system. But the lock-out typically locks the door the to the refrigerated system, preventing access to the entire unit, even if some of the products are not perishable or temperature-sensitive. Often the system must remained locked until the system is serviced, which can prevent access for hours or even days.

To accommodate these drawbacks, it is common to use multiple refrigerated systems to store different products having different temperature requirements. For example, often a dedicated system is needed for items that must be pre-chilled (e.g., perishable and temperature-sensitive products) and another dedicated system is needed for shelf-stable produces (e.g., non-perishable products).

Embodiments described herein overcome these and other challenges by providing—among other benefits—modular units for refrigerated systems that allow for controlling the temperature of each unit independently of other units or the remainder of the storage compartment within the refrigerated system. The temperature of each modular unit can be controlled independently of the other modular units and independent of the overall storage compartment of the refrigerated system. The modular units disclosed herein can lock out in response to, for example, temperature changes. This prevents access to only the modular unit that is locked out and allows a consumer to access the remainder of the refrigerated system. The modular units allow for convenient access to products while minimizing heat transfer to the chilled environment when the door of the refrigerated system is opened. The modular units disclosed herein can also be integrated into an existing refrigerated system and can be rearranged within the refrigerated system. This allows for flexible and more efficient storage of products.

Figure 2:
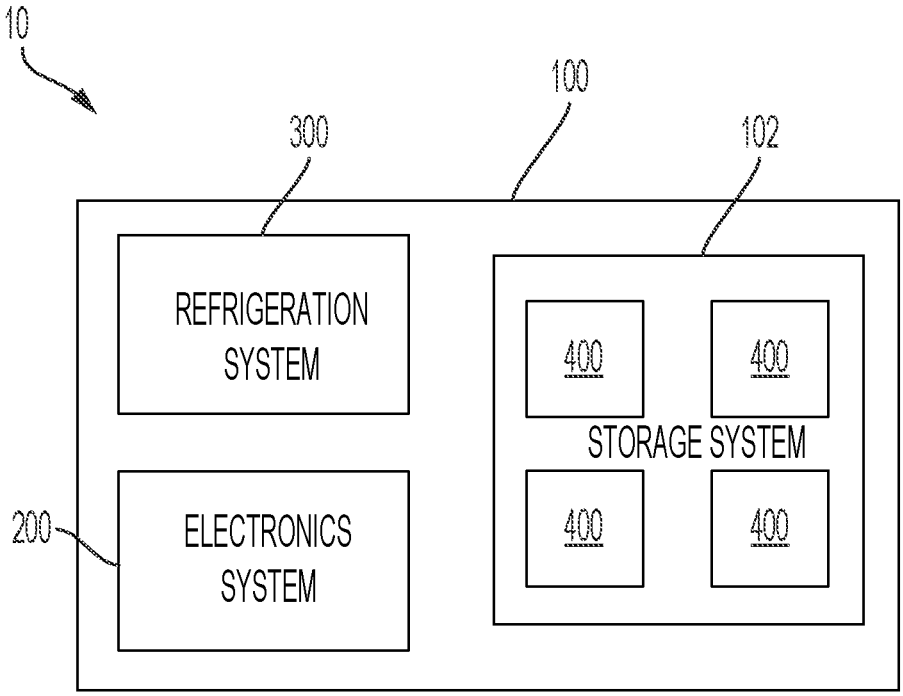
FIG. 2 shows a diagram of refrigeration systems including modular units according to some embodiments.

FIG. 1 shows a refrigerator system (e.g., system 10) according to some embodiments. FIG. 2 shows a diagram of system 10. In some embodiments, system 10 includes cabinet 100, electronics system 200, refrigeration system 300, storage compartment 102, and one or more modular storage units 400 disposed within storage compartment 102. In some embodiments, system 100 includes a storage compartment 102, side walls 105, front side 110, back side 115, and top 120.

In some embodiments, storage compartment 102 is defined in part by side walls 105, front side 110, back side 115, and top 120. In some embodiments, front side includes door 112. In some embodiments, door 112 includes a frame 113. In some embodiments, door 112 includes transparent portion 114. Transparent portion 114 can be made of various materials, such as glass or acrylic. In some embodiments, transparent portion 114 is glass. In some embodiments, transparent portion 114 is insulated glass. In some embodiments, storage compartment 102 is visible through transparent portion 114. Storage compartment 102 can include one or more shelves 150 disposed within storage compartment 102. In some embodiments, storage compartment 102 includes 1 or more (e.g., 2 or more, 3 or more, 4 or more, or 5 or more) shelves 150.

As shown in FIG. 1, system 10 can include modular storage units 400. In some embodiments, system 10 includes 1 or more (e.g., 2 or more, 3 or more, 4 or more, or 5 or more) modular storage units 400. Each modular storage unit 400 can be movable within storage compartment 102. In some embodiments, each modular storage unit is removably coupled to a shelf 150. FIGS. 3-5A show exemplary configurations of modular storage units 400. Each modular storage unit 400 can be configured to use the refrigeration system 300 of system 10 to redirect chilled air into modular storage unit 400. In some embodiments, as detailed below, modular storage unit 400 can continuous redirects chilled air from refrigeration system 300 to regulate the temperature of modular storage unit 400 separately from the remainder of storage compartment 102. In some embodiments, as detailed below, modular storage unit 400 can selectively redirect chilled air from refrigeration system 300 to regulate the temperature of modular storage unit 400 separately from the remainder of storage compartment 102.

Figure 3:
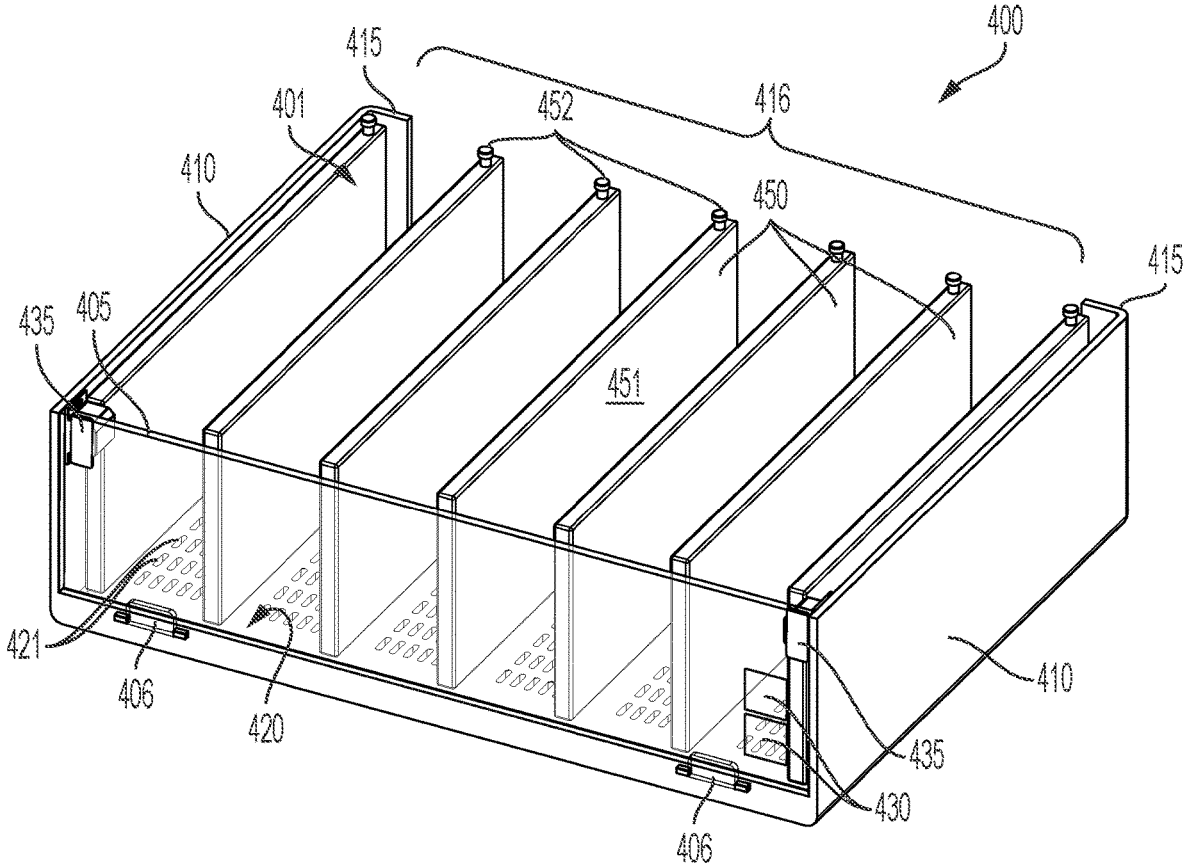
FIG. 3 shows a modular storage unit according to some embodiments.

FIG. 3 illustrates an exemplary modular storage unit 400. In some embodiments, modular storage unit includes door 405, side walls 410, back wall 415, and bottom 420. In some embodiments, modular storage unit 400 includes interior volume 401 defined at least partially by door 405, side walls 410, back wall 415, and bottom 420. In some embodiments, as back wall 415 includes opening 416 disposed in back 415. In some embodiments, opening 416 is an air inlet to receive chilled air from refrigeration system 300. In some embodiments, bottom 420 includes vents 421 that allow air to flow up through bottom 420 and into interior volume 401.

Figure 4:
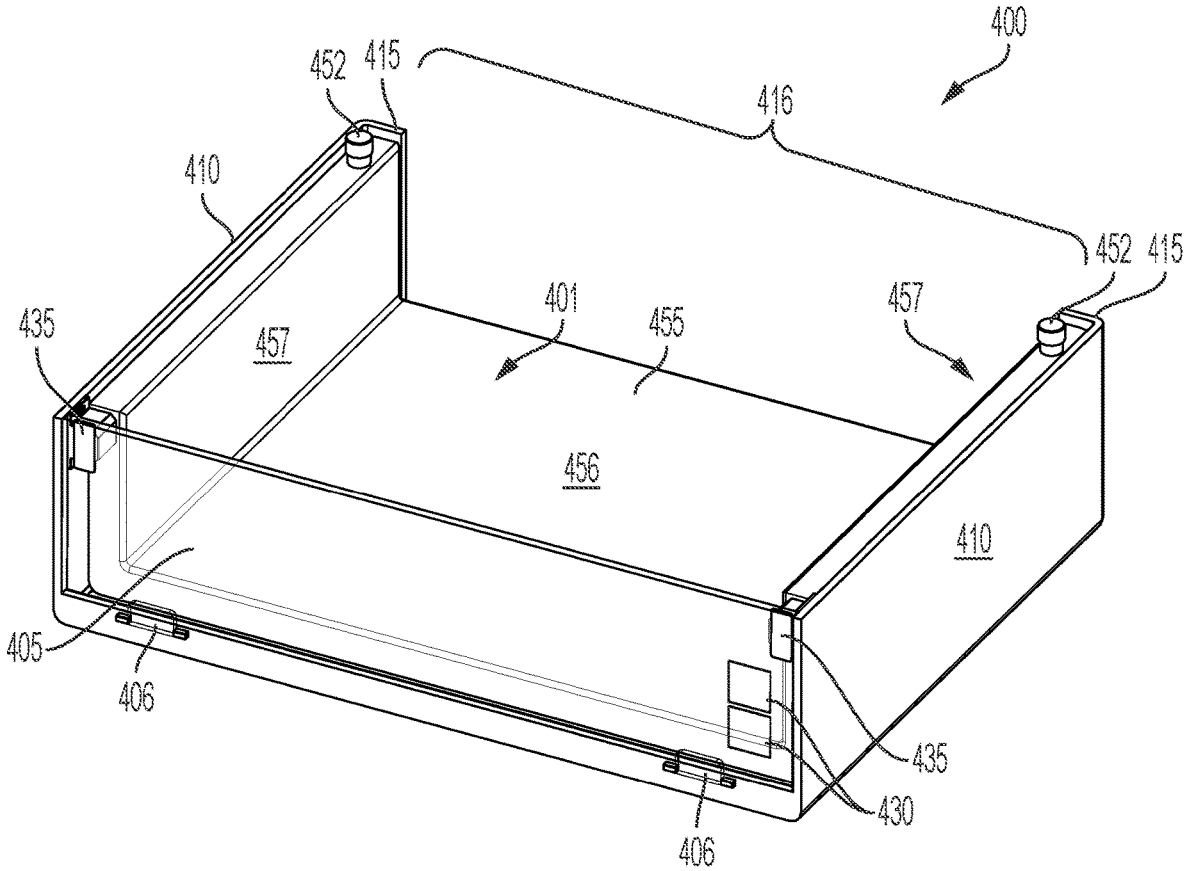
FIG. 4 shows a modular storage unit according to some embodiments.

Modular storage unit 400 can include door 405 that moves from a closed position to an open position. Door 405 can be hinged, rollable, or slidable. As shown in FIGS. 3 and 4, modular storage unit 400 can include door 405 that is hingedly coupled bottom 420 by hinge 406. After opening door 112 of cabinet 100, a user can access products stored within modular storage unit 400 by pulling door 405 from the top to rotate door 405 about hinges 406. In some embodiments, door 405 can be slidably coupled bottom 420, for example along a track defined in bottom 420. In some embodiments, door 405 is rollable (e.g., rollable curtain or spring-loaded roller). In some embodiments, door 405 is made of a transparent material (e.g., glass, acrylic, polycarbonate, polyethylene terephthalate (PET), or polyvinyl chloride (PVC)) such that products stored within modular storage unit 400 are visible before door 405 is opened.

As shown in FIGS. 3 and 4, door 405 can include one or more locks 435 configured to lock door 405. In some embodiments, lock 435 is an electromagnetic lock. In some embodiments, lock 435 is configured to lock and unlock based on certain conditions, for example when electronics 200 detects a payment source or that a temperature within modular storage unit 400 is exceeds a predetermined temperature. In some embodiments, modular storage unit 400 includes a temperature sensor (e.g., temperature sensor 220) that detects a temperature within modular storage unit 400. In some embodiments, if temperature sensor 220 detects that the temperature within modular storage unit 400 is at or above a predetermined temperature (e.g., 5° C., 3° C., or 1° C.), control unit 203 can activate lock 435 to prevent access to modular storage unit 400. Because warmer air may be able to enter modular unit 400 when door 405 is opened, this can minimize warmer air entering modular unit 400. In some embodiments, lock 435 is automatically locked based on the detection by temperature sensor 220. In some embodiments, lock 435 will remain locked until temperature sensor 220 detects that the temperature within modular storage unit 400 is below the predetermined temperature. In some embodiments, lock 435 is unlocked only when the temperature within modular storage unit 400 is below the predetermined temperature. Some temperature-sensitive products will spoil if they are stored at temperature above 5° C. for an extended period of time. Accordingly, in some embodiments, if temperature sensor 220 detects that the temperature within modular storage unit 400 is above the predetermined temperature for a predetermined time (e.g., 30 minutes, 60 minutes, or 90 minutes), lock 435 will remain locked until the modular storage unit 400 is restocked with new products. In some embodiments, the predetermined temperatures is about 40° F. to about 50° F. (e.g., about 41° F. to about 45° F.). In some embodiments, the predetermined time is about 1 minute to about 45 minutes (e.g., about 5 minutes to about 30 minutes or about 10 minutes to about 20 minutes). In some embodiments, the predetermined temperature is 45° F. and the predetermined time is 5 minutes. In some embodiments, the predetermined temperature is 41° F. and the predetermined time is 30 minutes.

Lock 435 can be a fail secure lock or a fail safe lock. In some embodiments, lock 435 is a fail secure lock that remains locked if system 100 loses power. This can be used, for example, to prevent a user from accessing a temperature-sensitive product if system 100 loses power. In some embodiments, lock 435 is a fail safe lock that unlocks if system 100 loses power. This can be used, for example, to allow access to shelf-stable products if system 100 loses power.

Modular storage unit 400 can have one or more indicators (e.g., indicator 430) that show a status of modular storage unit 400. In some embodiments, indicator 430 is a light that illuminates based on whether lock 435 is locked. For example, in some embodiments, indicator 430 is a light that illuminates when 435 is locked. In some embodiments, modular unit includes two indicators 430, as shown in FIGS. 3 and 4. In some embodiments, one indicator 430 illuminates when lock 435 is locked and the other indicator 430 illuminates when lock 435 is unlocked. In some embodiments, indicator 430 illuminates only when lock 435 is locked.

Modular storage unit 400 can have various arrangements within interior volume 401. For example, FIG. 3 shows an arrangement with a series of dividers 450, and FIG. 4 shows an arrangement with a U-shaped insert that contacts side walls 410 and bottom 420. Each of these are exemplary and are discussed in more detail below.

As shown in FIG. 3, modular storage unit 400 can have one or more insulating panels (e.g., dividers 450). In some embodiments, each divider 450 extends in a first direction between door 405 and back wall 415 such that sides 451 of dividers 450 are facing each other. In some embodiments, dividers 450 are parallel to each other. In some embodiments, dividers 450 are insulated panels. In some embodiments, dividers 450 contain a phase change material (e.g., paraffin wax, non-parrafin organics, hydrated salts, water, or gel) disposed within divider 450. In some embodiments, the phase change material is one of a paraffin wax, non-paraffin organic, or hydrated salt. Dividers 450 can be movable in a second direction between side walls 410 to adjust the space between each divider. The spacing between each divider 450 can be variable. For example, some dividers may be spaced apart sufficient to accommodate a can, while other dividers 150 in the same modular storage unit 400 may be spaced apparat to accommodate a snack that is wider than a can. This allows modular storage unit 400 to accommodate various sized products, and allows for easy reconfiguration if replacement products have a different size or shape. In some embodiments, the first direction and the second direction are perpendicular. In some embodiments, divider 450 includes inlet 452 that provide an access point for adding a phase change material to the dividers 450.

FIG. 4 illustrates modular storage unit 400 with insulating liner (e.g., liner 455). In some embodiments, the modular storage unit 400 shown in FIG. 4 includes the same features as modular storage unit 400 shown in FIG. 3, but with liner 455. In some embodiments, liner 455 can be used instead of, or in conjunction with, dividers 450 shown in FIG. 3. In some embodiments, liner 455 includes bottom wall 456 and side walls 457. In some embodiments, bottom wall 456 covers at least a portion of bottom 420. In some embodiments, each side wall 457 covers at least a portion of side walls 410. In some embodiments, liner 455 contains a phase change material (e.g., water or gel) disposed within liner 455.

Figure 5A:
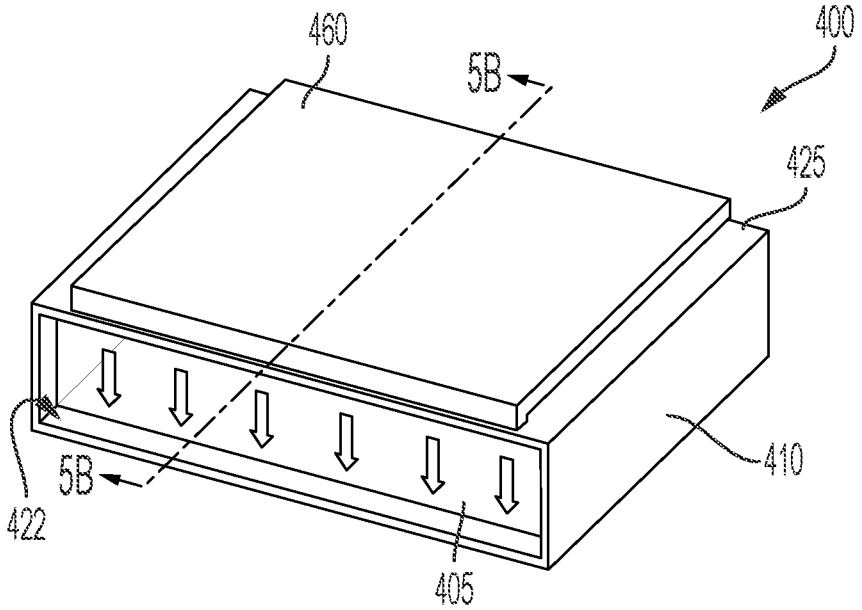
FIG. 5A shows a modular storage unit according to some embodiments.
Figure 5B:
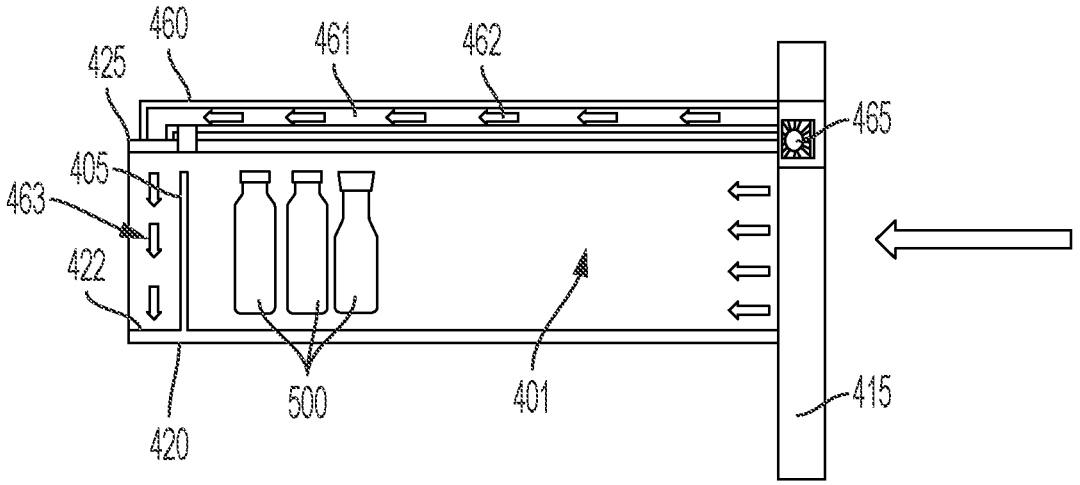
FIG. 5B shows a cross-section view of the modular unit of FIG. 5A.

FIG. 5A illustrates modular storage unit 400 according to some embodiments. FIG. 5B illustrates a cross-section of modular storage unit 400 shown in FIG. 5A taken along line 5B-5B. In some embodiments, modular storage unit 400 can include channel 460 extending from back wall 415 to proximate to a front side of door 405. As shown in FIG. 5B, channel 460 can include an inlet proximate to back wall 415 and an outlet proximate to a front side of door 405 interior volume 461 through which chilled air can flow (e.g., in the direction of arrows 462). In some embodiments, chilled air exits channel 460 and forms a chilled air curtain 463 in front door 405. In some embodiments, chilled air curtain 463 provides insulation in front of door 405. In some embodiments, modular storage unit 400 can include fan 465 that draws chilled air from refrigeration system 300 and into channel 460. In some embodiments, channel 460 and fan 465 as shown in FIGS. 5A and 5B can be used in conjunction with dividers 450 or liner 455 or both. FIG. 5B illustrates products 500 disposed in interior volume 401.

FIGS. 6A-9B illustrate various refrigeration systems 300 that can be used in system 10 according to some embodiments. It is to be understood that any of the modular storage units 400 described herein (e.g., as shown in FIGS. 3-5B) can be used in any of the systems shown in FIGS. 6A-9B. Additionally, it is to be understood that the modular storage units 400 shown in FIGS. 3-5B can be interchangeable with any other modular storage unit 400. In some embodiments, system 10 can include 1 or more (e.g., 2 or more, 3 or more, 4 or more, or 5 or more) modular storage units within storage compartment 102. In some embodiments, system 10 can include 1 to 4 modular storage units 400. Arrows shown in FIGS. 6A-9B illustrate the flow of air within system 10, with solid arrows illustrating the generally downward flow of colder air and dotted arrows illustrate the generally upward flow of warmer air.

In some embodiments, system 10 includes flow path 430 through which chilled air can flow down through storage compartment 402, as illustrated in FIGS. 6A-9B.

Figure 6A:
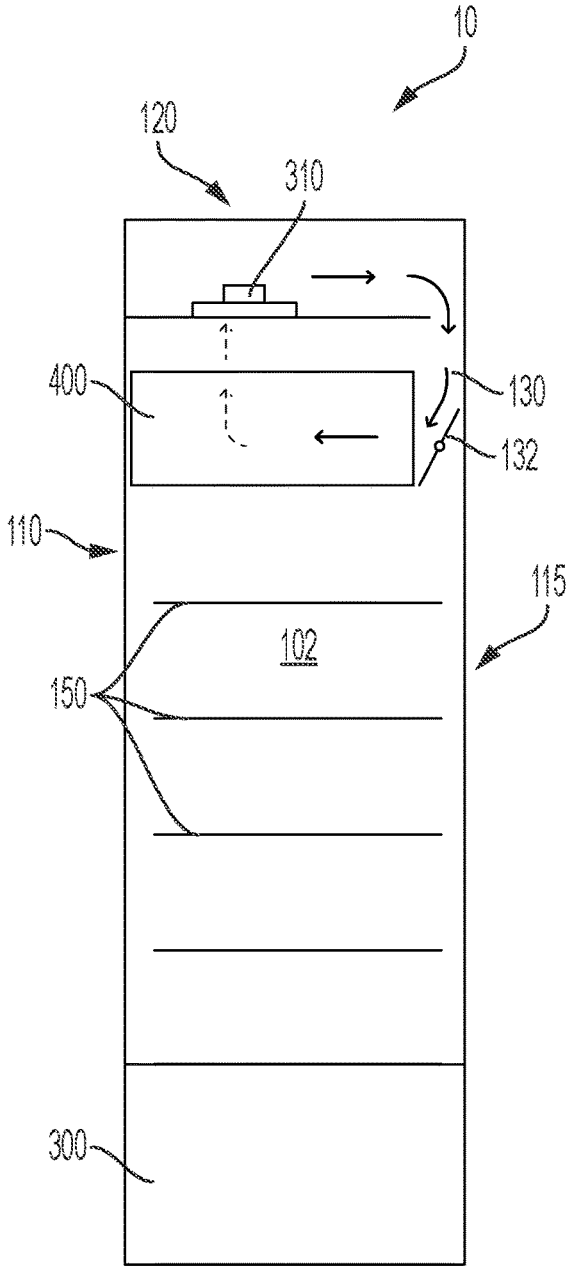
FIG. 6A shows a diagram of a refrigeration system according to some embodiments.
Figure 6B:
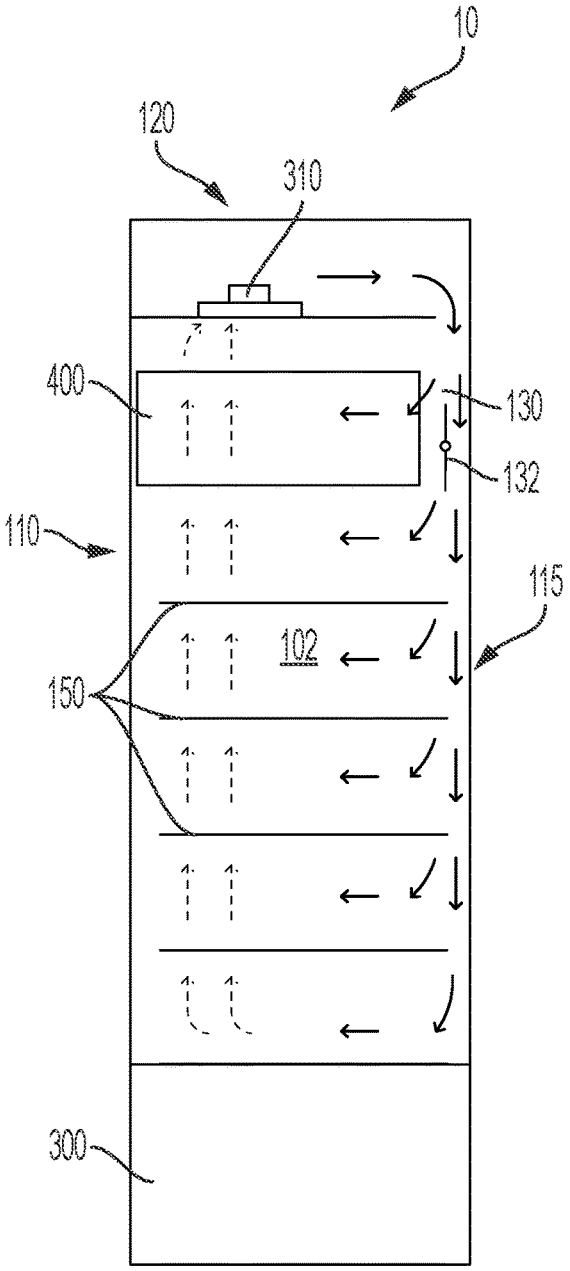
FIG. 6B shows a diagram of a refrigeration system according to some embodiments.

FIGS. 6A and 6B illustrate a damper system that can selectively direct chilled air into modular storage unit 400 (e.g., though opening 416 or channel 460). In some embodiments, damper system includes damper 132 that can actuate between a first position (shown in FIG. 6A) and a second position (shown in FIG. 6B). In some embodiments, when damper 132 is in the first position, chilled air flowing through flow path 130 is redirected into modular storage unit 400. In some embodiments, when damper 132 is in the second position, chilled air flows freely through flow path 130. In some embodiments, system 10 includes one damper per modular storage unit 400. In some embodiments, control unit 203 actuates damper 132 between the first position and the second position based on the temperature in modular storage unit 400, as determined by temperature sensor 220. For example, in some embodiments, when temperature sensor 220 detects that the temperature within modular storage unit 400 is at or above a predetermined temperature (e.g., 5° C., 3° C., or 1° C.), control unit 203 can move damper 132 to the first position (shown in FIG. 6A) to direct chilled air into modular storage unit 400. For example, in some embodiments, when temperature sensor 220 detects that the temperature within modular storage unit 400 is at or below a predetermined temperature (e.g., 5° C., 3° C., or 1° C.), control unit 203 can move damper 132 to the second position (shown in FIG. 6A) so that chilled air flow normally within system 10. In some embodiments, damper 132 can be used with any modular storage unit 400 disclosed herein.

Figure 7:
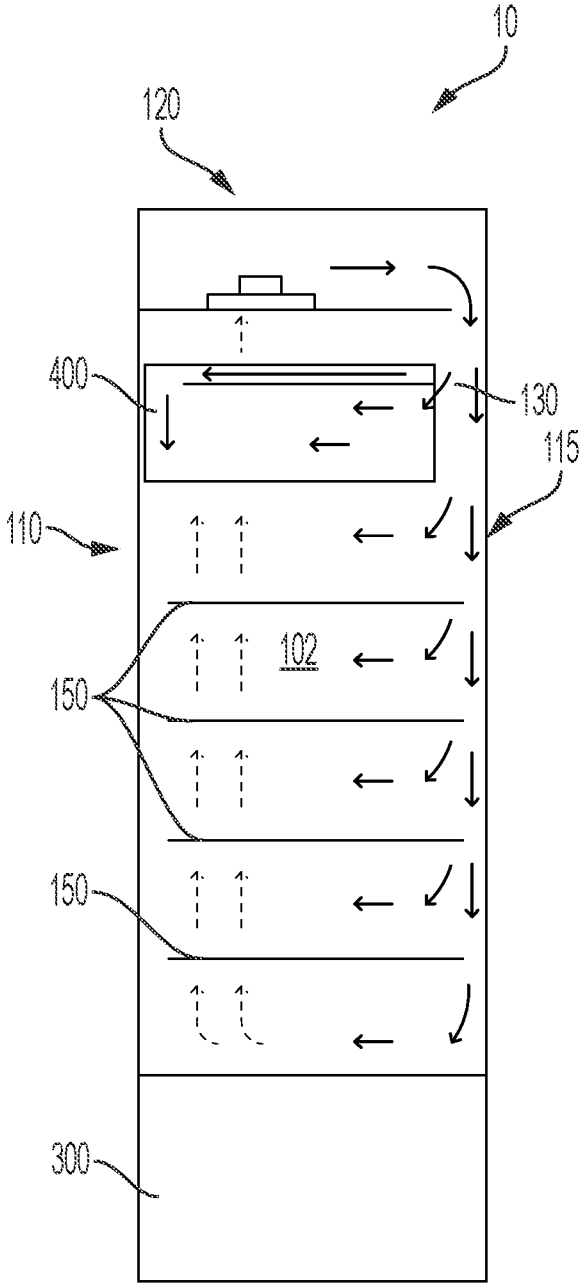
FIG. 7 shows a diagram of a refrigeration system according to some embodiments.

FIG. 7 illustrates air flow within system 10 when used with modular storage unit 400 illustrated in FIGS. 5A and 5B. As illustrated in FIG. 7, chilled air can be prioritized into modular storage unit 400, flow through channel 460, and form air curtain 463. As illustrated in FIG. 7, some chilled air flows into modular storage unit 400 and some chilled air flow through the remainder of storage compartment 102.

Figure 8:
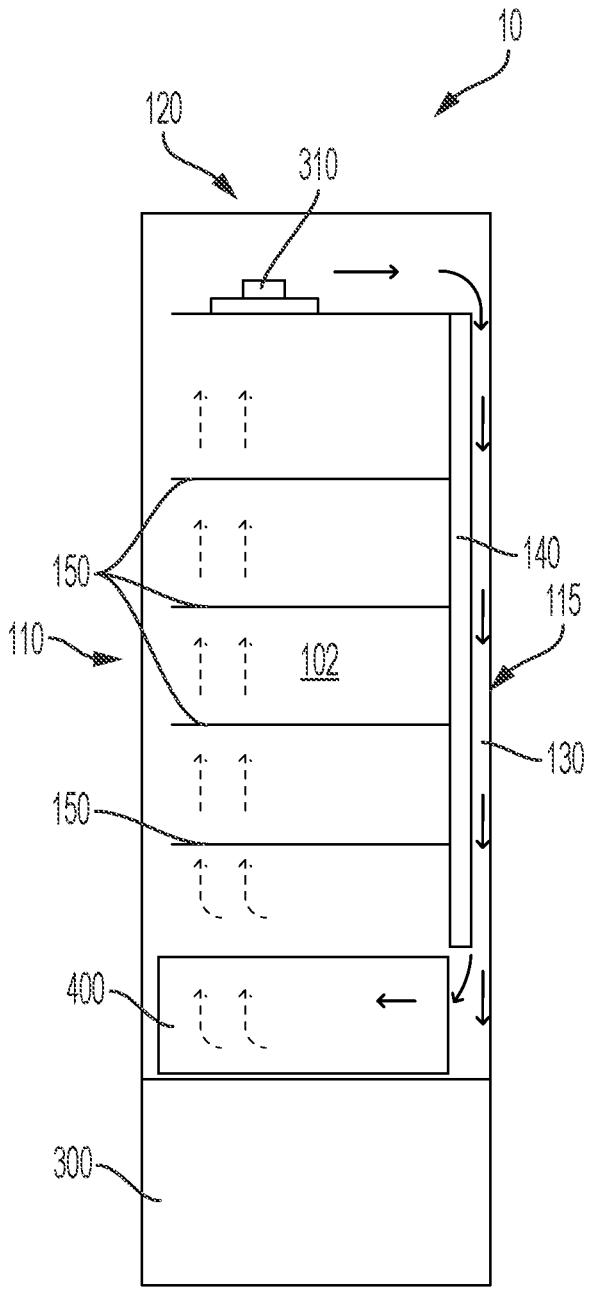
FIG. 8 shows a diagram of a refrigeration system according to some embodiments.

In some embodiments, as shown in FIG. 8, system 10 can include plate 140 disposed proximate to back wall 115. In some embodiments, plate 140 can extend vertically within storage compartment 102 and can be spaced apart from back wall 115 to form flow path 130. In some embodiments, plate 140 extends the entire width of storage compartment 102 (e.g., between side walls 105). In some embodiments, when plate 140 is used, all chilled air flows from the top of storage compartment 102, through flow path 130, to the bottom of storage compartment 102. In some embodiments, plate 140 includes a phase change material (e.g., water or gel) disposed within plate 140.

Figure 9:
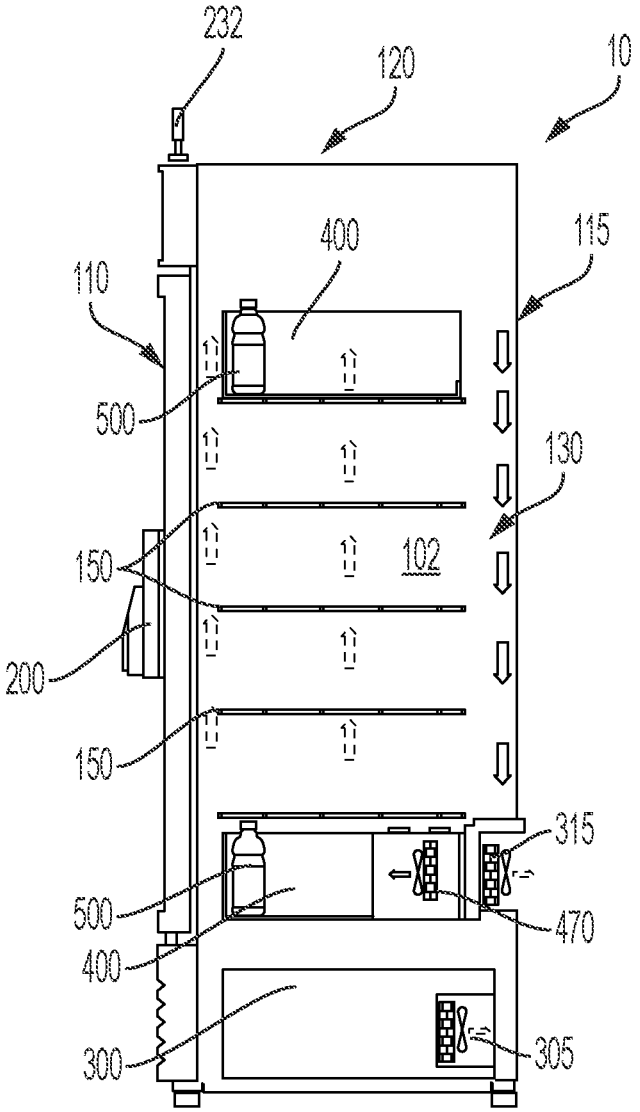
FIG. 9 shows a diagram of a refrigeration system according to some embodiments.

In some embodiments, as illustrated in FIG. 9, modular storage unit 400 can include a micro-refrigeration unit (e.g., refrigeration unit 470) disposed within modular storage unit 400. In some embodiments, as shown in FIG. 9, system 10 can include multiple modular storage units 400 with different designs (e.g., one or more with refrigeration unit 470 and one or more without refrigeration unit 470). System 10 can include fans 305 and 315. In some embodiments, refrigeration unit 470 can control the temperature within modular storage unit 400, and refrigeration system 300 can control the temperature in the remainder of storage compartment 102.

Figure 10:
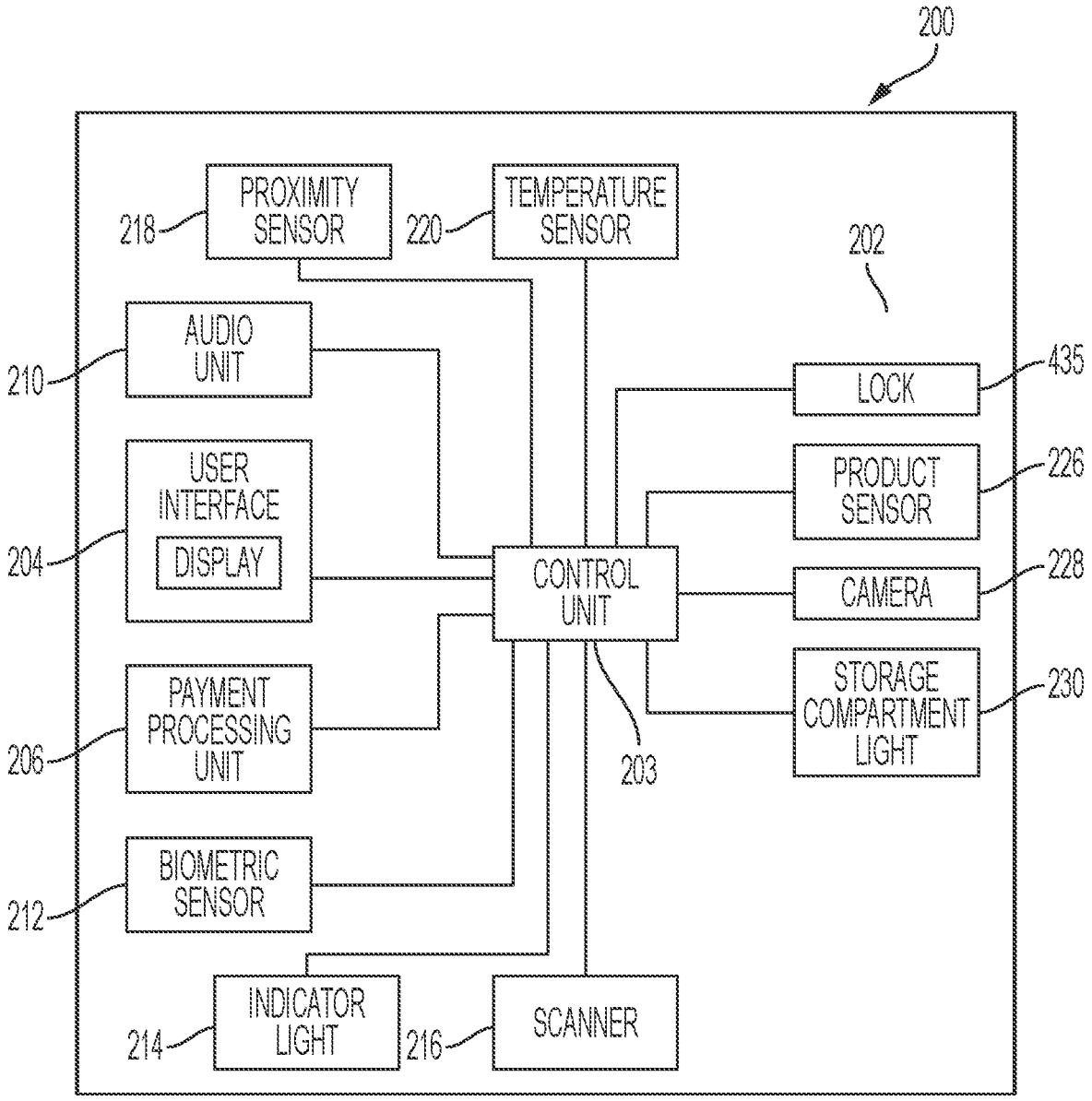
FIG. 10 shows a diagram of electronics systems of mobile vending systems according to some embodiments.

FIG. 10 illustrates a diagram of electronics system 200 according to some embodiments. In some embodiments, electronics system 200 includes control unit 203, user interface 204, payment processing unit 206, audio unit 210, sensors (e.g., contactless payment sensor 211, biometric sensor 212, proximity sensor 218, temperature sensor 220, product sensor 226), scanner 216, lock 224, camera 228, and storage compartment light 230.

In some embodiments, control unit 203 coordinates operation of system 10, as shown in FIG. 10. In some embodiments, a single control unit 203 can control operation of all components of mobile vending system 100. In some embodiments, two or more control units 203 can be used, and each control unit can be used to control different operations or components of system 10. For example, a first control unit can control user interface 204 and payment processing unit 206, while a second control unit can control, for example, operation of lock 224, product sensor 226, camera 228, and storage compartment light 230. While it is understood that multiple control units 203 can be used, for convenience, the description herein refers primarily to embodiments having a single control unit 203.

In some embodiments, as illustrated in FIG. 1, system 10 includes user interface 204. In some embodiments, user interface 204 is controlled by control unit 203. In some embodiments, electronics system 200 includes housing 250. In some embodiments, user interface 204 can be arranged on housing 250. In some embodiments, as illustrated in FIG. 10, user interface 204 is a display. In some embodiments, user interface 204 can show instructions for operating system 10 and may further show product information to a consumer during a product vending operation. In some embodiments, user interface 204 includes a liquid crystal display (LCD), a light emitting diode (LED) display, an organic-LED (OLED) display, among other types of displays. In some embodiments, user interface 204 receives user input. In some embodiments, user interface 204 includes a touch-screen display such that a consumer can touch a portion of the display to enter a user input.

In some embodiments, electronics system 200 can includes payment processing unit 206 for detecting the presence of a payment source, receiving payment from a consumer, processing the payment, and authorizing purchases of products. In some embodiments, payment processing unit 206 is arranged on housing 250. In some embodiments, payment processing unit 206 includes at least one of magnetic stripe reader 207 for reading a credit card, debit card, ATM card, and the like; a chip reader for reading credit cards, debit cards, and other payment cards having electronic chips, i.e., chip cards; a contactless payment sensor (e.g., an near filed communication (NFC) reader) for contactless payments. Payment processing unit 206 can also be configured to receive a mobile payment, such as a payment made using Apple Pay or Google Pay, and can include an RFID sensor configured to read or detect an RFID tag, or a QR code reader configured to scan a QR code or a barcode displayed on a printed membership card, a shopping bag, a bottle, among other items, or a QR code displayed on a mobile device, such as on a software application (or "app") on the mobile device. Further, payment processing unit 206 can be configured to receive a remote payment or an indication that a consumer has made a payment, such as a payment made on a smartphone or an application on a smartphone, and the indication of remote payment is transmitted to system 10 to allow a consumer to purchase a product without entering payment at system 10.

In some embodiments, payment processing unit 206 can be used to detect an authorized user. In some embodiments, an authorized user can be determined by entering an identification of a user, such as by entering a user's name wherein the user's name is stored in a database, scanning an identification such as a driver's license or passport, or by entering an identification code. Further, electronics system 200 can include a biometric sensor for determining an identity of a consumer, and, thus, the presence of an authorized user. A consumer's identity can be tied to a payment source, such that upon identification of the consumer, the consumer's payment source can be automatically accessed for purchasing a product. In some embodiments, the biometric sensor can be configured to identify an individual based on a fingerprint, a palm-print, a retina, an iris, a face or facial feature, among other biometrics.

In some embodiments, electronics system 200 can include audio unit 210. In some embodiments, audio unit 210 is configured to emit or produce an audible alert or tone. In some embodiments, audio unit 210 can be arranged on or within housing 250, or can be located external to housing 250 such as on upper portion 101 or lower portion 102 of mobile vending system 100. In some embodiments, audio unit 210 can be in wired or wireless communication with system 10. In some embodiments, audio unit 210 can include a memory to store one or more pre-recorded sounds, tones, or messages, among other audible alerts. In some embodiments, audio unit 210 can be configured to play a greeting or welcome to a consumer upon detection of a consumer or upon receipt of a payment source. Further, in some embodiments, audio unit 210 can play a message to thank the consumer upon completion of a purchase. In some embodiments, audio unit 210 can also be configured to produce an alert when a product is removed from or is returned to a product storage compartment of system 10, as discussed in further detail below.

In some embodiments, system 10 includes proximity sensor 218 that is configured to detect when a consumer is within a predetermined distance of system 10. In some embodiments, when a consumer is nearby system 10, as determined by proximity sensor 218, system 10 can change from a first state to a second state. In some embodiments, the first state is an inactive state in which the user interface 204 is turned off or in a power save mode and storage compartment light 230 is off. In some embodiments, the second state is an active state in which user interface 204 turned on and ready to receive user input and storage compartment light is on. In some embodiments, when a consumer completes a purchase using mobile vending system 100, user interface 204 can change from the second state to the first state.

In some embodiments, system 10 includes temperature sensor 220. In some embodiments, system 10 includes one or more temperature sensors 220 is configured to detect the temperature within system 10 (e.g., within storage compartment 102 or within modular storage unit 400). In some embodiments, temperature sensor 220 is configured to detect when the temperature within modular storage unit 400 is above or below a predetermined temperature, as discussed above.

In some embodiments, system 10 includes scanner 216 configured to scan a barcode on a product. In some embodiments, control unit 203 is configured to request payment based on the scanned product. In some embodiments, control unit 203 is configured to display, on user interface 204, information about the scanned product (e.g., price, nutritional information, ingredients).

In some embodiments, mobile vending system 100 includes an inventory management system. In some embodiments, inventory management system includes one or more product sensors configured to detect when a product has been removed from, or returned to storage compartment 102 or modular storage unit 400. In some embodiments, product sensor can be an optical sensor, such as a camera (e.g., camera 228), configured to detect and identify a product removed from system 10. For example, optical sensor can capture a video of products as they pass by sensor while being removed from or inserted into storage compartment 102 and can compare the products in the captured video with an image library, such as an edge or cloud-based image library. Alternatively, optical sensors can capture images of products within storage compartment before and after a consumer's purchase to determine which products have been removed. However, various types of sensors can be used to detect removal and return of a product from system 10 as will be readily understood by one of ordinary skill in the art. For example, other types of sensors that can be used instead of or in addition to optical sensors include weight sensors to determine a weight of products in storage compartment before and after products are removed, or radio frequency identification (RFID) tags and RFID readers/scanners to detect removal and return of products.

In some embodiments, the product sensor can identify a product by detecting a shape and/or color of a product removed from storage compartment 102. In some embodiments, the product sensor can be positioned proximate to a front portion of storage compartment 102. In some embodiments, the product sensor can define a plane parallel to a front surface of storage compartment 102 so as to detect when a product passes through the plane, indicating that a product is being removed from or returned to storage compartment 102.

Figure 11:
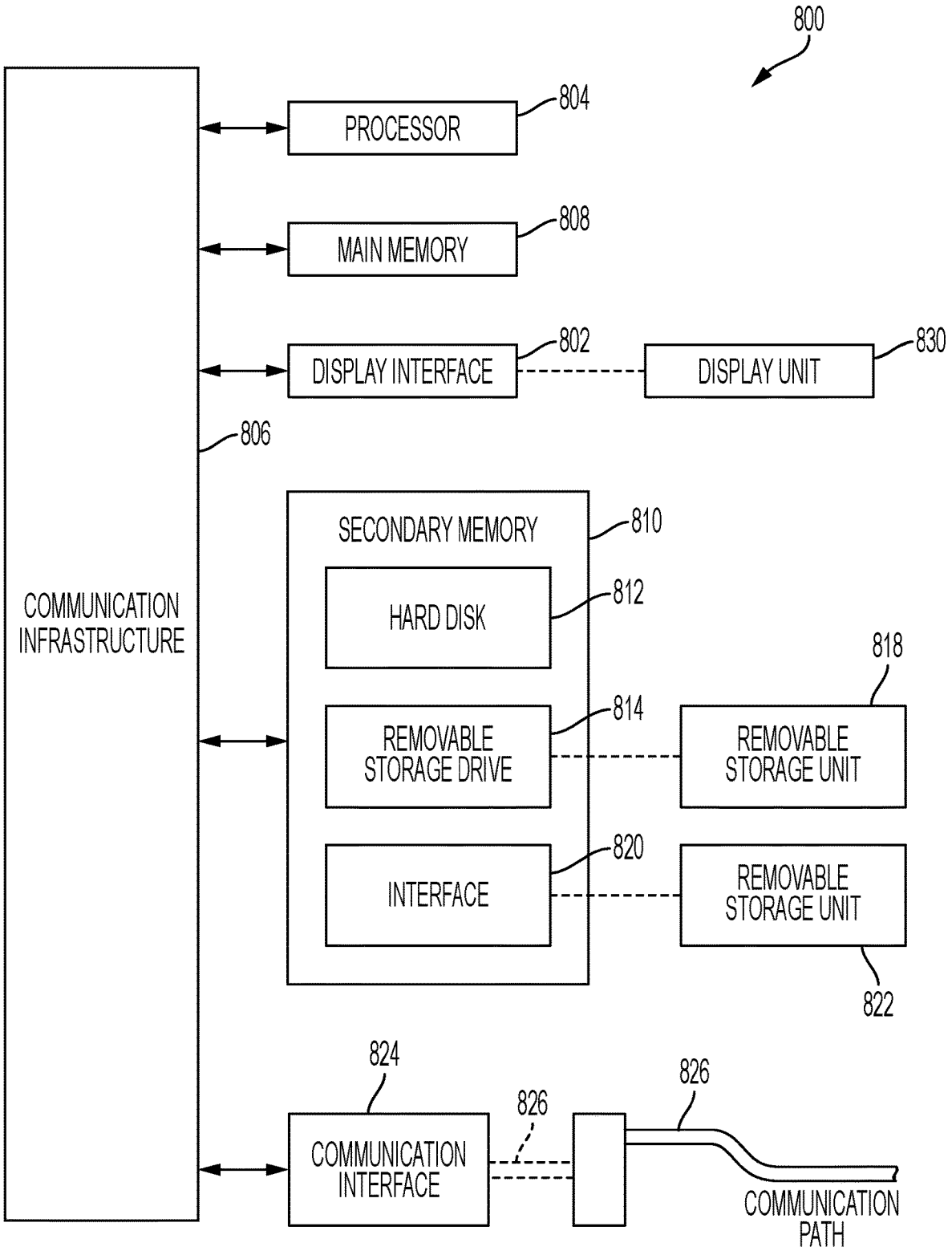
FIG. 11 shows a schematic block diagram of a computer system in which some embodiments can be implemented.

FIG. 11 illustrates a computer system 800 in which embodiments, or portions thereof, can be implemented as computer-readable code. Control unit 203 as discussed herein can be computer systems having all or some of the components of computer system 800 for implementing processes discussed herein.

If programmable logic is used, such logic can execute on a commercially available processing platform or a special purpose device. One of ordinary skill in the art can appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that can be embedded into virtually any device.

For instance, at least one processor device and a memory can be used to implement the above described embodiments. A processor device can be a single processor, a plurality of processors, or combinations thereof. Processor devices can have one or more processor "cores."

Embodiments described herein can be implemented in terms of this example computer system 800. After reading this description, it will become apparent to a person skilled in the relevant art how to implement embodiments described herein using other computer systems and/or computer architectures. Although operations can be described as a sequential process, some of the operations can in fact be performed in parallel, concurrently, and/or in a distributed environment, and with program code stored locally or remotely for access by single or multi-processor machines. In addition, in some embodiments the order of operations can be rearranged without departing from the spirit of the disclosed subject matter.

Processor device 804 can be a special purpose or a general purpose processor device. As will be appreciated by persons skilled in the relevant art, processor device 804 can also be a single processor in a multi-core/multiprocessor system, such system operating alone, or in a cluster of computing devices operating in a cluster or server farm. Processor device 804 is connected to a communication infrastructure 806, for example, a bus, message queue, network, or multi-core message-passing scheme.

Computer system 800 also includes a main memory 808, for example, random access memory (RAM), and can also include a secondary memory 810. Secondary memory 810 can include, for example, a hard disk drive 812, or removable storage drive 814. Removable storage drive 814 can include a floppy disk drive, a magnetic tape drive, an optical disk drive, a flash memory, or the like. The removable storage drive 814 reads from and/or writes to a removable storage unit 818 in a well-known manner. Removable storage unit 818 can include a floppy disk, magnetic tape, optical disk, a universal serial bus (USB) drive, etc. which is read by and written to by removable storage drive 814. As will be appreciated by persons skilled in the relevant art, removable storage unit 818 includes a computer usable storage medium having stored therein computer software and/or data.

Computer system 800 (optionally) includes a display interface 802 (which can include input and output devices such as keyboards, mice, etc.) that forwards graphics, text, and other data from communication infrastructure 806 (or from a frame buffer not shown) for display on display unit 830.

In alternative implementations, secondary memory 810 can include other similar means for allowing computer programs or other instructions to be loaded into computer system 800. Such means can include, for example, a removable storage unit 822 and an interface 820. Examples of such means can include a program cartridge and cartridge interface (such as that found in video game devices), a removable memory chip (such as an EPROM, or PROM) and associated socket, and other removable storage units 822 and interfaces 820 which allow software and data to be transferred from the removable storage unit 822 to computer system 800.

Computer system 800 can also include a communication interface 824. Communication interface 824 allows software and data to be transferred between computer system 800 and external devices. Communication interface 824 can include a modem, a network interface (such as an Ethernet card), a communication port, a PCMCIA slot and card, or the like. Software and data transferred via communication interface 824 can be in the form of signals, which can be electronic, electromagnetic, optical, or other signals capable of being received by communication interface 824. These signals can be provided to communication interface 824 via a communication path 826. Communication path 826 carries signals and can be implemented using wire or cable, fiber optics, a phone line, a cellular phone link, an RF link or other communication channels.

As used herein, the terms "computer program medium" and "computer usable medium" are used to generally refer to media such as removable storage unit 818, removable storage unit 822, and a hard disk installed in hard disk drive 812. Computer program medium and computer usable medium can also refer to memories, such as main memory 808 and secondary memory 810, which can be memory semiconductors (e.g., DRAMs, etc.).

Computer programs (also called computer control logic) are stored in main memory 808 and/or secondary memory 810. Computer programs can also be received via communication interface 824. Such computer programs, when executed, enable computer system 800 to implement the embodiments as discussed herein. In particular, the computer programs, when executed, enable processor device 804 to implement the processes of the embodiments discussed here. Accordingly, such computer programs represent controllers of the computer system 800. Where the embodiments are implemented using software, the software can be stored in a computer program product and loaded into computer system 800 using removable storage drive 814, interface 820, and hard disk drive 812, or communication interface 824.

Embodiments described herein be directed to computer program products comprising software stored on any computer useable medium. Such software, when executed in one or more data processing device, causes a data processing device(s) to operate as described herein. Embodiments described herein can employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

Figure 12:
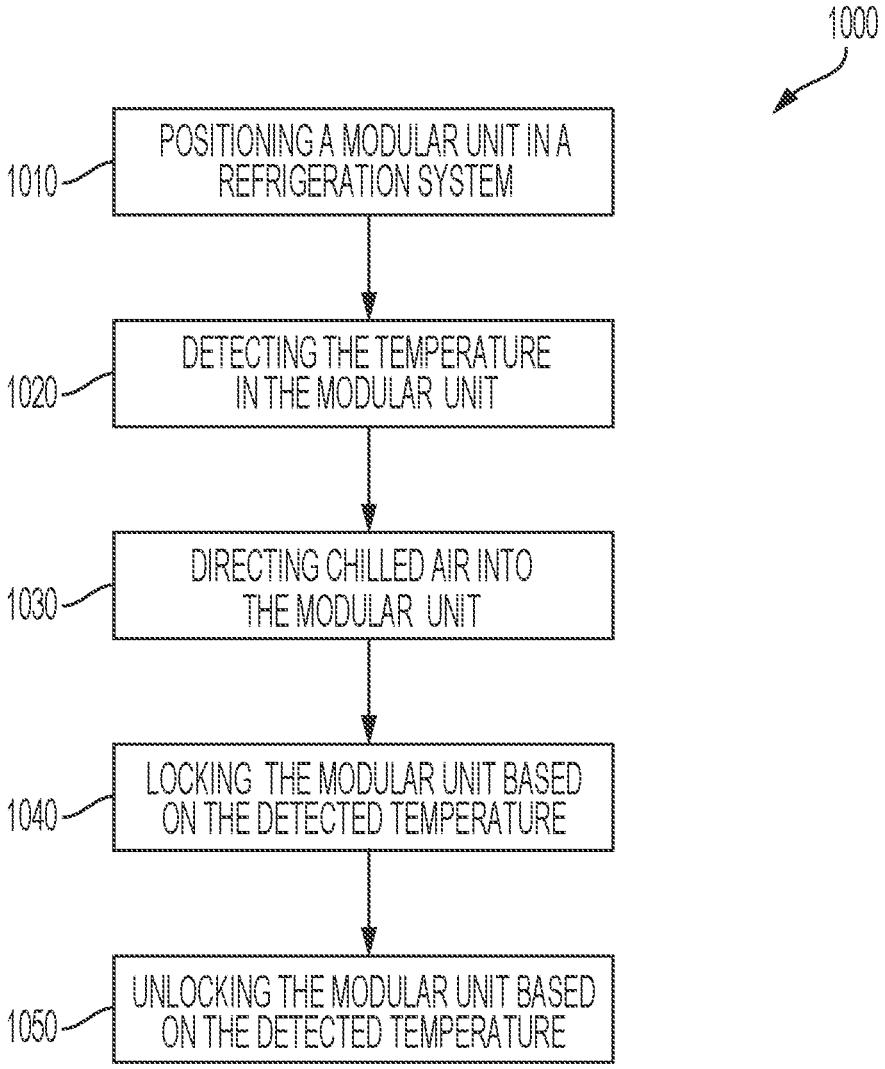
FIG. 12 shows a method for independently controlling temperature of modular storage units according to some embodiments.

FIG. 12 illustrates method 1000 according to some embodiments. In some embodiments, at step 1010, one or more modular storage units (e.g., modular storage unit 400) can be positioned in a storage compartment (e.g., storage compartment 102) of a cabinet (e.g., cabinet 100). In some embodiments, the modular storage units are coupled to the storage compartment, as described above. In some embodiments, at step 1020, one or more temperature sensors (e.g., temperature sensor 220) can detect the temperature in the modular storage unit and/or in the storage compartment. In some embodiments, at step 1030, chilled air can be directed into the storage compartment. In some embodiments, chilled air is directed into the storage compartment based on the temperature detected at step 1020. For example, in some embodiments, step 1030 is performed only when the temperature in the one or more modular storage units is greater than or equal to a predetermined temperature, as discussed above. In some embodiments, step 1030 is performed continuously (e.g., chilled air is continuously directed to the modular storage unit). In some embodiments, at step 1040, the modular storage unit is locked based on the detected temperature at step 1020. For example, in some embodiments, at step 1040, the modular storage unit can be locked if the temperature sensor at step 1020 detects that the temperature in the modular storage unit is greater than a predetermined temperature, as described above. In some embodiments, at step 1050, the modular storage unit can be unlocked if the temperature sensor at step 1020 detects that the temperature in the modular storage unit is less than a predetermined temperature, as described above. In some embodiments, step 1050 is optional and is not performed for perishable or temperature-sensitive products, For example, in some embodiments, once temperature sensor at step 1020 detects that the temperature in the modular storage unit is greater than a predetermined temperature, modular unit can be locked and remain locked until the inventory (e.g., product 500) is replaced.

As used herein, the terms "upper" and "lower," and "top" and "bottom," "inner" and "outer," and the like are intended to assist in understanding of embodiments of the disclosure with reference to the accompanying drawings with respect to the orientation of the components as shown, and are not intended to be limiting to the scope of the disclosure or to limit the disclosure scope to the embodiments depicted in the Figures. The directional terms are used for convenience of description and it is understood that components described herein may be positioned in any of various orientations.

As used herein, when the term "about" is used in describing a value or an end-point of a range, the disclosure should be understood to include the specific value or end-point referred to. As used herein, the term "about" may include ±10%.

It is to be appreciated that the Detailed Description section, and not any other section, is intended to be used to interpret the claims. Other sections may set forth one or more but not all exemplary embodiments of the present disclosure as contemplated by the inventor(s), and thus, are not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The above examples are illustrative, but not limiting, of the present disclosure. Other suitable modifications and adaptations of the variety of conditions and parameters normally encountered in the field, and which would be apparent to those skilled in the art, are within the spirit and scope of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The breadth and scope of the present disclosure should not be limited by any of the above-described exemplary embodiments, but should be defined only in accordance with the claims and their equivalents.

What is claimed is:

1. A modular storage unit for a refrigeration system, the modular storage unit comprising:

an interior volume defined by:

a door, the door being movable from a closed position to an open position;

a back wall;

side walls; and a base;

an air inlet for receiving chilled air from the refrigeration system;

a temperature sensor configured to detect the temperature within the interior volume;

an insulating wall comprising a phase change material disposed within the insulating wall, wherein the insulating wall is oriented in a first direction that is substantially perpendicular to the back wall and substantially parallel to the side walls;

a locking system configured to lock the door, wherein the modular storage unit is removably coupled to an interior storage compartment of the refrigeration system, wherein the interior storage compartment is defined by walls and a refrigeration system door that is movable from a closed position to an open position.

2. The modular storage unit of claim 1, further comprising a second insulating wall oriented in the first direction.

3. The modular storage unit of claim 2, wherein the insulating wall and the second insulating wall are each movable in a second direction that is perpendicular to the first direction.

4. The modular storage unit of claim 2, further comprising a U-shaped insulating tray, wherein the U-shaped insulating tray comprises the insulating wall and the second insulating wall.

5. The modular storage unit of claim 1, wherein the locking system is configured to lock the door in response to the temperature sensor detecting that the temperature within the interior volume exceeds a predetermined temperature, and wherein the locking system is configured to unlock the door in response to the temperature sensor detecting that the temperature within the interior volume is less than the predetermined temperature.

6. The modular storage unit of claim 5, wherein the locking system comprises an electromagnetic lock.

7. The modular storage unit of claim 6, wherein the electromagnetic lock is a fail secure lock.

8. The modular storage unit of claim 1, further comprising an indicator disposed on the door, wherein the indicator is configured to provide an indication that the locking system is locked.

9. The modular storage unit of claim 1, wherein modular storage unit is enclosed within the interior storage compartment when the refrigeration system door is in the closed position.

10. The modular storage unit of claim 1, wherein the air inlet is disposed in the back wall.

11. A system comprising:

the modular storage unit of claim 1; and a second modular storage unit, wherein the modular storage unit and the second modular storage unit are both disposed in the interior storage compartment of the refrigeration system.

12. The system of claim 11, wherein the second modular storage unit comprises a second air inlet for receiving chilled air from the refrigeration system.

13. The system of claim 11, wherein the second modular storage unit comprises a second insulating wall comprising a phase change material disposed within the second insulating wall.

14. The system of claim 11, wherein the second modular storage unit is disposed above the modular storage unit.

15. The system of claim 1, wherein the refrigeration system door comprises a user interface.

16. The system of claim 15, wherein the user interface comprises a display.

17. A modular storage unit for a refrigeration system, the modular storage unit comprising:

an interior volume defined by:

a door having an inner surface facing the interior volume and an outer surface, the door movable from a closed position to an open position;

a back wall, wherein the back wall comprises a phase change material disposed within the back wall;

side walls; and a base;

an air inlet for receiving chilled air from the refrigeration system;

a temperature sensor configured to detect the temperature within the interior volume;

an insulating wall comprising a phase change material disposed within the insulating wall, wherein the insulating wall is oriented in a first direction that is substantially perpendicular to the back wall;

a locking system configured to lock the door, wherein the modular storage unit is removably coupled to an interior storage compartment of the refrigeration system, and wherein the modular storage unit comprises an air duct extending from the back wall to a front end of the modular storage unit, wherein the air duct is configured to deliver chilled air from the refrigeration system to an area proximate to the outer surface of the door.

18. The modular storage unit of claim 17, wherein the door is recessed from a front end of the side walls such that the chilled air delivered through the air duct forms an air curtain.

19. The modular storage unit of claim 17, further comprising a fan configured to move the chilled air from the refrigeration system through the air duct.

* * * * *